US009352572B2

(12) United States Patent
Derleth et al.

(10) Patent No.: US 9,352,572 B2
(45) Date of Patent: May 31, 2016

(54) SYSTEM FOR DETECTING INOPERATIVE INKJETS IN THREE-DIMENSIONAL OBJECT PRINTING USING AN OPTICAL SENSOR AND MOVABLE TEST SUBSTRATES

(71) Applicant: Xerox Corporation, Norwalk, CT (US)

(72) Inventors: David S. Derleth, Webster, NY (US); Frank B. Tamarez Gomez, Webster, NY (US); Matthew D. Savoy, Webster, NY (US); Annie Liu, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/231,195

(22) Filed: Mar. 31, 2014

(65) Prior Publication Data

US 2015/0273857 A1 Oct. 1, 2015

(51) Int. Cl.
*B41J 29/393* (2006.01)
*B41J 2/165* (2006.01)

(52) U.S. Cl.
CPC ..... *B41J 2/16579* (2013.01)

(58) Field of Classification Search
USPC ..... 347/19
See application file for complete search history.

(56) References Cited

U.S. PATENT DOCUMENTS

| | | | | |
|---|---|---|---|---|
| 6,755,499 | B2 * | 6/2004 | Castano et al. | 347/19 |
| 2003/0234828 | A1 * | 12/2003 | Walker | 347/19 |
| 2004/0012112 | A1 | 1/2004 | Davidson et al. | |
| 2006/0055719 | A1 * | 3/2006 | Furuya et al. | 347/14 |
| 2006/0111807 | A1 | 5/2006 | Gothait et al. | |
| 2006/0141145 | A1 | 6/2006 | Davidson et al. | |
| 2009/0011066 | A1 | 1/2009 | Davidson et al. | |
| 2010/0151136 | A1 | 6/2010 | Davidson et al. | |

FOREIGN PATENT DOCUMENTS

WO 03/026876 A2 4/2003

OTHER PUBLICATIONS

Blue LEDS—Filling the World With New Light, The Royal Swedish Academy of Sciences, https://www.nobelprize.org/nobel_prizes/physics/laureates/2014/popular-physicsprize2014.pdf, 2014.

* cited by examiner

*Primary Examiner* — Stephen Meier
*Assistant Examiner* — Alexander D Shenderov
(74) *Attorney, Agent, or Firm* — Maginot Moore & Beck LLP

(57) ABSTRACT

An apparatus detects inoperative inkjets during printing of three-dimensional objects. The apparatus includes an optical sensor that generates measurements of a height, a diameter, and a position for test dots formed on a substrate with material ejected from a printhead. These measurements are analyzed to detect inoperative inkjets to enable printhead maintenance at appropriate times to maintain the operational status of the inkjets in the printhead.

18 Claims, 6 Drawing Sheets

SYSTEM FOR DETECTING INOPERATIVE INKJETS IN THREE-DIMENSIONAL OBJECT PRINTING USING AN OPTICAL SENSOR AND MOVABLE TEST SUBSTRATES

TECHNICAL FIELD

The device disclosed in this document relates to printers that produce three-dimensional objects and, more particularly, to the accurate detection of inoperative inkjets in such printers.

BACKGROUND

Digital three-dimensional manufacturing, also known as digital additive manufacturing, is a process of making a three-dimensional solid object from a digital model of virtually any shape. Three-dimensional printing is an additive process in which one or more printheads eject successive layers of material on a substrate in different shapes. Three-dimensional printing is distinguishable from traditional object-forming techniques, which mostly rely on the removal of material from a work piece by a subtractive process, such as cutting or drilling.

The production of a three-dimensional object with these printers can require hours or, with some objects, even days. One issue that arises in the production of three-dimensional objects with a three-dimensional printer is consistent functionality of the inkjets in the printheads that eject the drops of material that form the objects. During printing of an object, one or more inkjets can deteriorate by ejecting the material at an angle, rather than normal, to the printhead, ejecting drops that are smaller than an inkjet should eject, or by failing to eject any drop at all. An inkjet suffering from any of these operational deficiencies is known as an inoperative inkjet. If the operational status of one or more inkjets deteriorates during object printing, the quality of the printed object cannot be assessed until the printing operation is completed. Consequently, print jobs requiring many hours or multiple days can produce objects that do not conform to specifications due to inoperative inkjets in the printheads. Once such objects are detected, the printed objects are scrapped, restorative procedures are applied to the printheads to restore inkjet functionality, and the print job is repeated. An apparatus that enables detection of inoperative inkjets while printing would enable restorative procedures to be applied during object printing so a properly formed object can be produced. In this manner, product yield for the printer is improved and its printing is more efficient. The apparatus should be able to detect inoperative inkjets that eject a multitude of printing materials, such as clear, colored, translucent, phosphorescent, and waxy materials.

SUMMARY

An apparatus that enables inoperative inkjet detection in three-dimensional printers includes a supply of substrate, an optical sensor configured to generate data corresponding to a height, a diameter, and a position of drops of material on the substrate, a transport configured to move the substrate and material on the substrate to a position opposite the optical sensor, and a controller operatively connected to the transport, the optical sensor, the controller being configured to operate the transport to move the substrate to the position opposite the optical sensor after a plurality of inkjets in a printhead has been operated to eject a predetermined number of drops of material from each inkjet in the printhead onto the substrate to form a test dot for each inkjet in the printhead on the substrate, and to identify inoperable inkjets in the printhead with reference to the data received from the optical sensor that corresponds to the height, the diameter, and the position of each test dot on the substrate.

A printer that incorporates the apparatus for detecting inoperative inkjets includes a printhead configured with inkjets to eject material, a supply of substrate configured to move a substrate to a position opposite the printhead to receive drops of material ejected from inkjets in the printhead, an optical sensor configured to generate data corresponding to a height, a diameter, and a position of the drops of material on the substrate, a transport configured to move the substrate and material on the substrate to a position opposite the optical sensor, and a controller operatively connected to the transport, the optical sensor, and the printhead, the controller being configured to operate the printhead to eject a predetermined number of drops of material from each inkjet in the printhead onto the substrate while the substrate remains stationary at the position opposite the printhead to enable the predetermined number of drops of material to form a test dot for each inkjet in the printhead on the substrate, to operate the transport to move the substrate from being opposite the printhead to being opposite the optical sensor, and to identify inoperable inkjets in the printhead with reference to the data received from the optical sensor that corresponds to the height, the diameter, and the position of each test dot on the substrate.

BRIEF DESCRIPTION OF THE DRAWINGS

The foregoing aspects and other features of an apparatus or printer that detects inoperative inkjets during three-dimensional printing are explained in the following description, taken in connection with the accompanying drawings.

DETAILED DESCRIPTION

Figure 1:
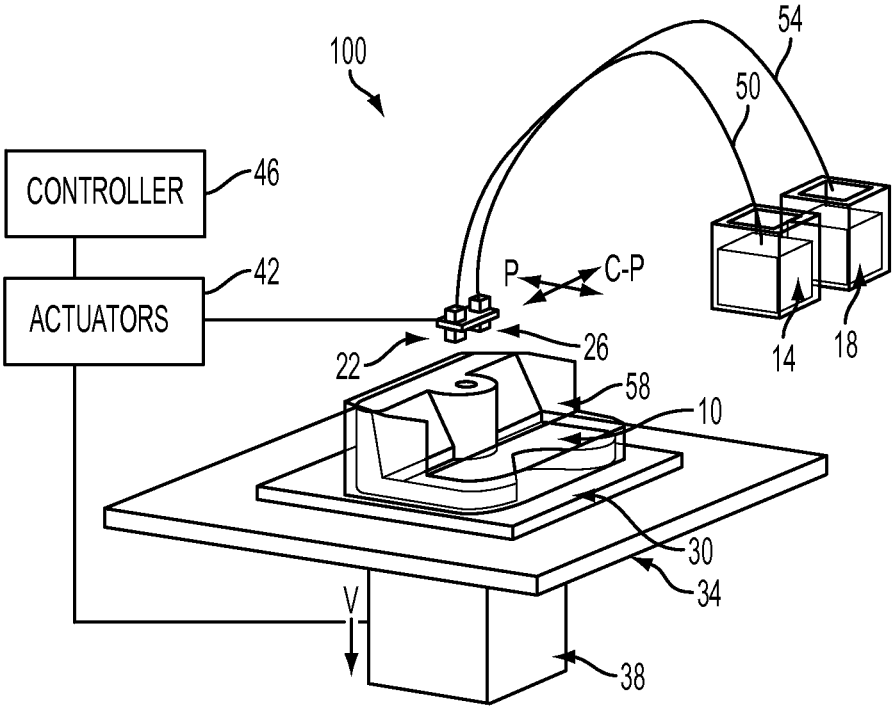
FIG. 1 is a perspective view of a three-dimensional object printer.

For a general understanding of the environment for the device disclosed herein as well as the details for the device, reference is made to the drawings. In the drawings, like reference numerals designate like elements.

FIG. 1 shows a configuration of components in a printer 100, which produces a three-dimensional object or part 10. As used in this document, the term "three-dimensional printer" refers to any device that ejects material with reference to image data of an object to form a three-dimensional object. The printer 100 includes a support material reservoir 14, a build material reservoir 18, a pair of inkjet printheads 22, 26, a build substrate 30, a planar support member 34, a columnar support member 38, an actuator 42, and a controller 46. Conduit 50 connects printhead 22 to support material reservoir 14 and conduit 54 connects printhead 26 to build material reservoir 18. Both inkjet printheads are operated by the controller 46 with reference to three-dimensional image data in a memory operatively connected to the controller to eject the support and build materials supplied to each respective printhead. The build material forms the structure of the part 10 being produced, while the support structure 58 formed by the support material enables the build material to maintain its shape while the material solidifies as the part is being constructed. After the part is finished, the support structure 58 is removed by washing, blowing, or melting.

The controller 46 is also operatively connected to at least one and possibly more actuators 42 to control movement of the planar support member 34, the columnar support member 38, and the printheads 22, 26 relative to one another. That is, one or more actuators can be operatively connected to structure supporting the printheads to move the printheads in a process direction and a cross-process direction with reference to the surface of the planar support member. Alternatively, one or more actuators can be operatively connected to the planar support member 34 to move the surface on which the part is being produced in the process and cross-process directions in the plane of the planar support member 34. As used herein, the term "process direction" refers to movement along one axis in the surface of the planar support member 34 and "cross-process direction" refers to movement along an axis in the planar support member surface that is orthogonal to the process direction axis in that surface. These directions are denoted with the letters "P" and "C-P" in FIG. 1. The printheads 22, 26 and the columnar support member 38 also move in a direction that is orthogonal to the planar support member 34. This direction is called the vertical direction in this document, is parallel to the columnar support member 38, and is denoted with the letter "V" in FIG. 1. Movement in the vertical direction is achieved with one or more actuators operatively connected to the columnar member 38, by one or more actuators operatively connected to the printheads 22, 26, or by one or more actuators operatively connected to both the columnar support member 38 and the printheads 22, 26. These actuators in these various configurations are operatively connected to the controller 46, which operates the actuators to move the columnar member 38, the printheads 22, 26, or both in the vertical direction.

Figure 2:
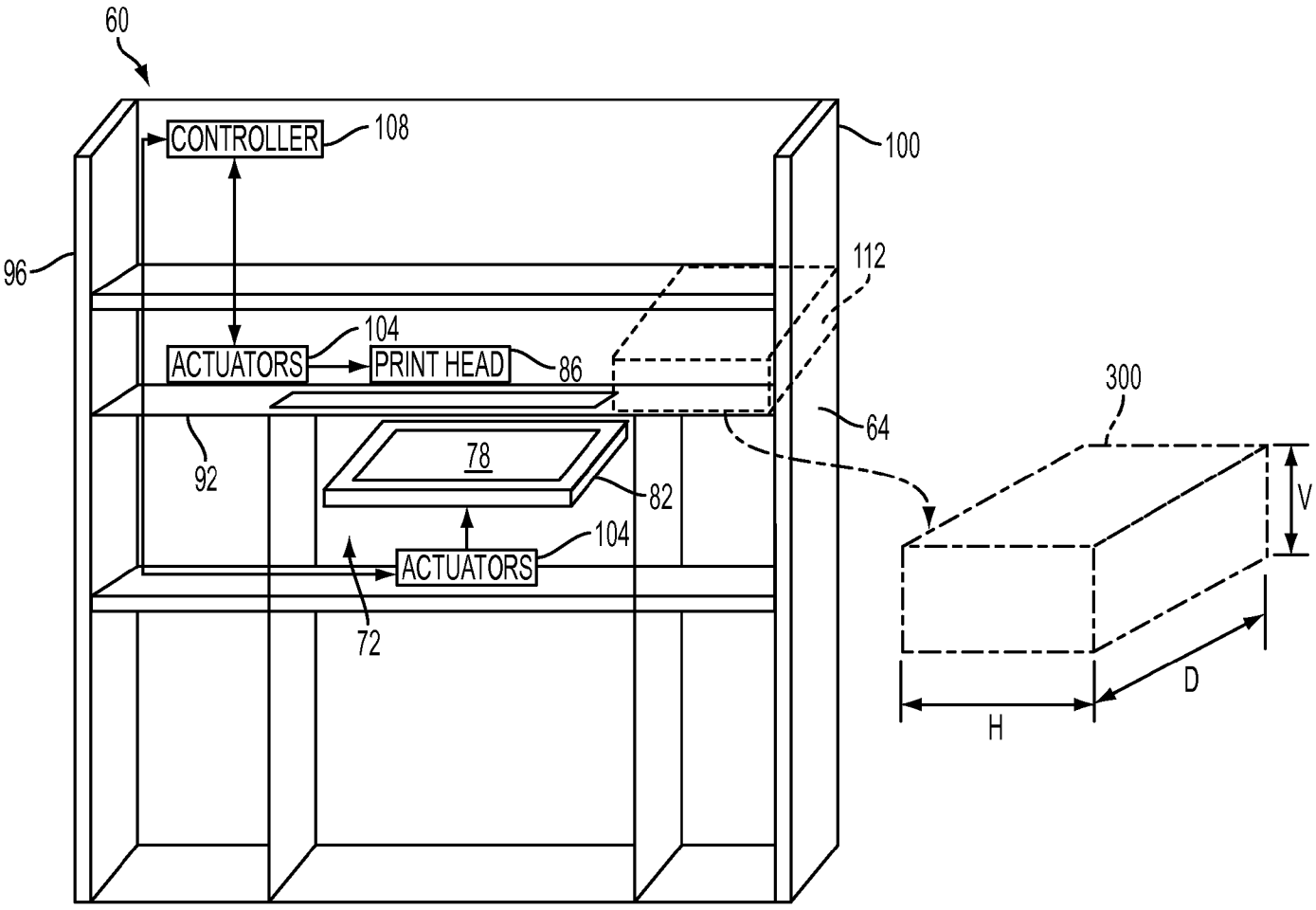
FIG. 2 is front view of a three-dimensional object printer having a housing that depicts a space within the housing for a module that enables inoperative inkjets in the printhead to be detected during a printing operation.

A three-dimensional object printer with a housing is shown in FIG. 2. That printer 60 has a housing 64. Within the housing 64 are six compartments that are generally cubic in shape. The housing 64 is shown in FIG. 2 without the doors that close to conceal the compartments. Compartment 72 includes a planar support 78 on a movable platform 82. Movable platform 82 is configured with one or more actuators and guide members (not shown) to enable the movable platform 82 to move up and down in a vertical direction. The planar support 78 is the surface on which a three-dimensional object is formed. In some embodiments, the printhead 86 has a length that is approximately equal to the length of the planar support 78 in the direction from the back wall of compartment 72 to the opening at the front of the compartment. In these embodiments, printhead 86 is mounted on support member 92 in the space between sidewalls 96 and 100 of housing 64 for linear reciprocating movement only. In other embodiments, the printhead 86 has a length that is less than the length of the planar support 78 in the direction from the back wall of compartment 72 to the opening at the front of the compartment. In these embodiments, printhead 86 is mounted on support member 92 in the space between sidewalls 96 and 100 of housing 64 for reciprocating movement in two orthogonal directions in a plane above compartment 72. In these various embodiments, one or more actuators 104 are operatively connected to the printhead 86. Controller 108 operates the actuators 104 to move the printhead 86 either linearly back and forth on support member 92 or to move the printhead in two orthogonal directions within a plane. By selectively operating the inkjets in the printhead 86, vertically moving the support platform 82, and horizontally moving the printhead 86 on the member 92, a three-dimensional object can be formed on the planar support 78.

The area 112 outlined in dashes in FIG. 2 identifies the placement of a module that optically senses a test pattern of material on a substrate to detect inoperative inkjets in the printer 60. As noted above, if an inkjet fails during printing of an object by either completely or partially failing to eject material or by errantly ejecting material in a skewed direction, the object being produced is malformed. Currently, this malformation cannot be detected until production of the object is finished. By using area 112 for optically sensing inoperative inkjets, printer 60 can be configured to detect inoperative inkjets during object production as described more fully below. Some components within the module 300 can move in the horizontal direction H, depth direction D, and vertical direction V as shown in the figure.

Figure 3:
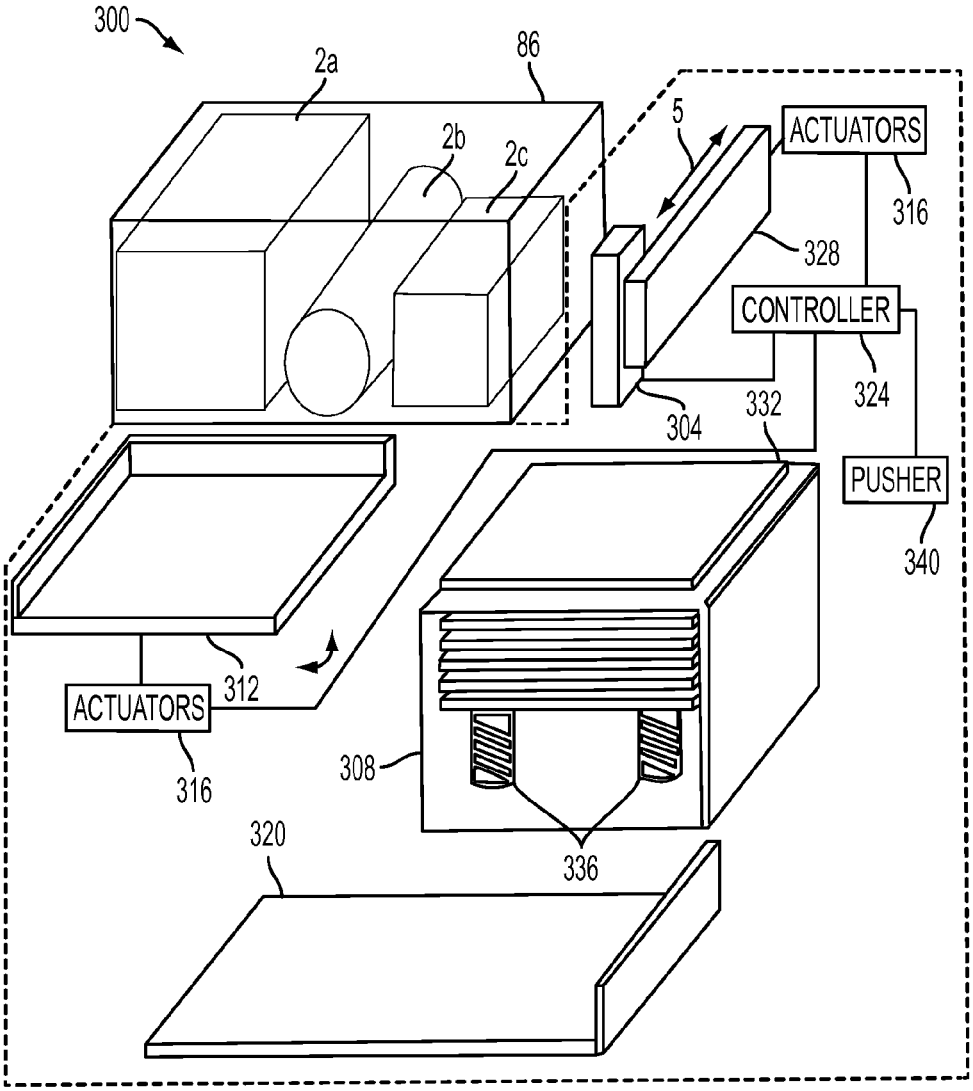
FIG. 3 is a perspective view of a module for detecting inoperative inkjets that fits in the space 112 shown in FIG. 2.

One embodiment of a module that detects inoperative inkjets during object printing is shown in the block diagram of FIG. 3. The module 300 is configured to fit within area 112 of printer 60. The module 300 includes an optical sensor 304, a substrate supply 308, a support member 312, one or more actuators 316, a collection tray 320, and a controller 324. The optical sensor 304 is mounted for movement along guide rail 328 and the guide rail 328 is operatively connected to an actuator 316 to move the optical sensor 304 from a position over the substrate supply 308 to a position over the support member 312 and back again. The controller 324 is operatively connected to the actuators 316 to move the optical sensor 304 and guide rail as described, to displace a substrate 332 from the supply 308 to the support member 312, and to pivot the support member 312 to drop a substrate from the support member 312 into the collection tray 320. Alternatively, the guide rail 328 and the optical sensor 304 can be fixedly mounted to the printhead 86 so controller 108 can operate actuators 104 (FIG. 2) to move the printhead 86 and the sensor 304. As shown in the figure, printhead 86 can include an ejector head 2*a*, a curing device 2*b*, and a planarizer 2*c*, although the curing device 2*b* and planarizer 2*c* are not needed for materials that do not require curing or trimming. The substrates 332 in the substrate supply 308 are planar members made of a material that supports the build material and the support material ejected from the printhead 86. For example, the planar substrates could be a plastic or other hard polymer substrate. The substrate supply 308 includes a lifting mechanism 336 that lifts the substrates 332 as a pushing mechanism 340 removes a single substrate from the supply and positions it onto the support member 312. The lifting mechanism 336 can be a spring-loaded mechanism, an air spring, a mechanically actuated jack, or the like. The pushing mechanism 340 can be a solenoid or the like. The guide rail that supports the optical sensor 304 is operatively connected to one of the actuators 316 to move the guide rail 328 and the optical sensor 304 between the position over the substrate supply 308 and the position over the support member 312 in a reciprocating manner between the two positions. When the guide rail 328 and the sensor 304 are over the substrate supply 308, the printhead 86 can be moved above a substrate 332 on the support member 312 to enable printing of a test pattern on the substrate. When the guide rail 328 and the sensor 304 are over the support member 312, the sensor 304 is moved along the guide rail 328 to enable generation of image data of the test pattern on the substrate 332.

Figure 4:
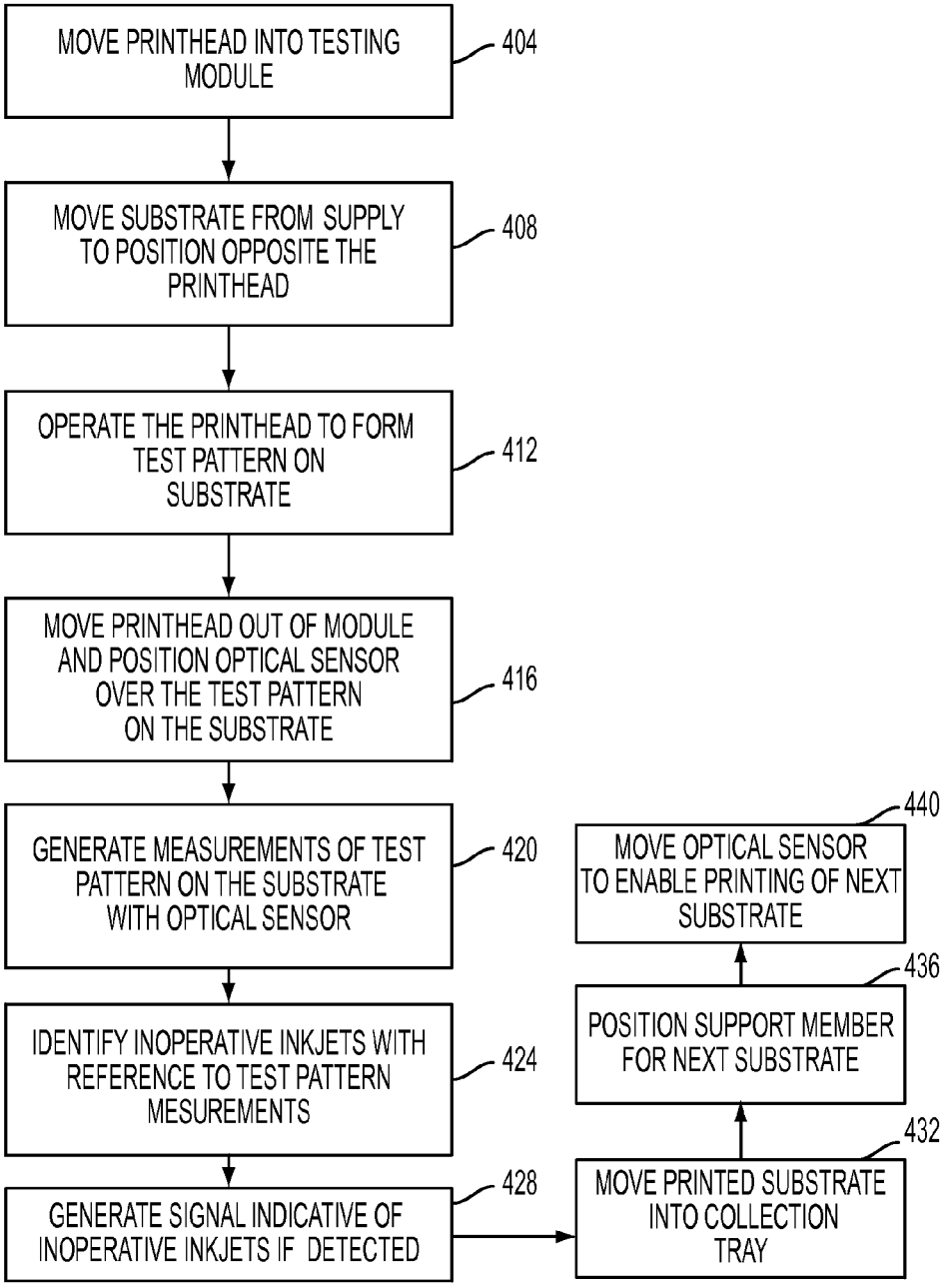
FIG. 4 is a flow diagram of a method for operating the module of FIG. 3.

A method of operating a printer that produces three-dimensional objects is shown in FIG. 4. In the description of this method, statements that a process is performing some task or function refers to a controller or general purpose processor executing programmed instructions stored in a memory operatively connected to the controller or processor to manipulate data or to operate one or more components in the printer to perform the task or function. The controller 324 noted above can be such a controller or processor. Alternatively, the controller 324 can be implemented with more than one processor and associated circuitry and components, each of which is configured to form one or more tasks or functions described herein.

At predetermined times in the printing operation, the controller 108 (FIG. 2) operates an actuator 104 to move the printhead 86 into the module 300 located in the area 112 (block 404). In response to the controller 324 detecting the printhead in the module 300, controller 324 operates the pushing mechanism 340 to move a substrate 332 onto the support member 312 (block 408). Controller 324 then generates a signal to the controller 108 to operate the inkjets in the printhead to print a test pattern on the substrate (block 412). In one embodiment, each inkjet in the printhead is repetitively operated to deposit material on a portion of the substrate 304 opposite the inkjet. After the test pattern is printed, controller 108 moves the printhead 86 out of the module 300 and generates a signal for controller 324. In response to the signal from controller 108, controller 324 operates an actuator 316 to move the guide rail 328 and the optical sensor 304 to a position opposite the test pattern on the substrate 332 (block 416). The optical sensor 304 is then moved along the guide rail 328 to emit a light towards the test pattern on the substrate 332, receive the reflections from the test pattern and substrate, and generate measurements of the test pattern on the substrate 332 (block 420). These measurements are analyzed to identify inoperative inkjets (block 424) and, if inoperative inkjets are identified, a signal indicative of the defective printhead is generated for the operator of the printer (block 428). The operator can then take appropriate action. The process continues by controller 324 operating an actuator 316 to rotate the support member 312 about one end of the member to enable the substrate on which the test pattern was printed to drop into the collection tray 320 (block 432). The actuator operation is then reversed to return the support member 312 to the position for receiving the next substrate 332 (block 436). By operating another actuator 316, the controller 324 returns the guide rail 328 and the optical sensor 304 to the position over the substrate supply 308 (block 436).

In one embodiment, the optical sensor 304 is a blue laser sensor available from Keyence Corporation of America, Itasca, Ill. in the LJ-V7000 series of two dimensional and three-dimensional laser measurement systems. This sensor can generate measurements of the heights and the diameters of the collections of material drops on the substrate 332 as well as positional data regarding the location of the collections. These data can be used to determine whether the collections are located where they are expected to be and whether the mass of material is within a predetermined range of tolerance. Measurements that indicate an inkjet is ejecting too much or too little material or is ejecting the material with a skewed trajectory are indicative of inoperative inkjets. Alternatively, the optical sensor 304 can generate image data of the test pattern on the substrate 332 that are then analyzed to identify inoperative inkjets.

Figure 5:
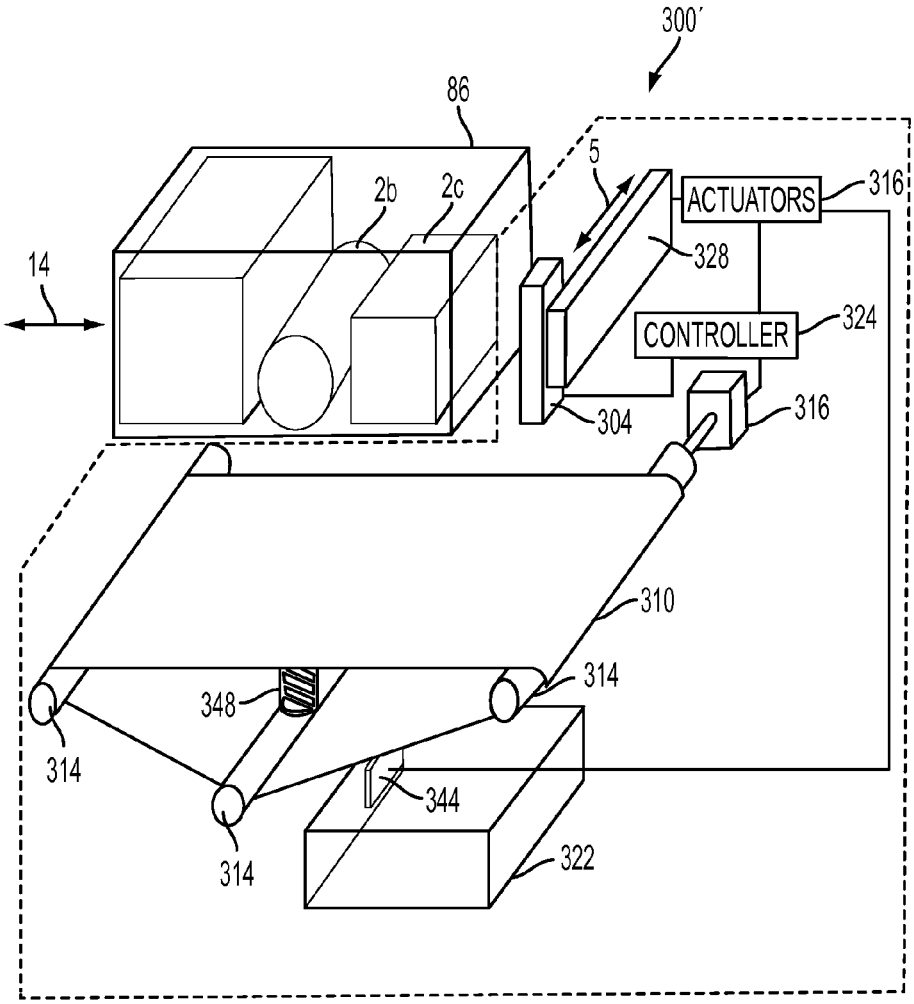
FIG. 5 is an alternative embodiment of a printer having a module for detecting inoperative inkjets during printing of a three-dimensional object.

In another embodiment shown in FIG. 5, the optical sensor module 300' is formed with an endless belt substrate for the printing of the test pattern. The module 300' is also configured to fit within area 112 of printer 60. Using like numbers for like components, the module 300' includes an optical sensor 304, an endless substrate belt 310 entrained about three rollers 314, one or more actuators 316, a waste receptacle 322, a controller 324, a cleaning member 344, and a tensioning mechanism 348. The optical sensor 304 is mounted for movement along guide rail 328 and the guide rail 328 is operatively connected to an actuator 316 to enable the optical sensor 304 to be moved between two positions. One position for the optical sensor 304 over the endless substrate 310 enables the test pattern to be printed and the other position over the endless substrate 310 enables the optical sensor 304 to generate measurements of the test pattern on the endless substrate. The controller 324 is operatively connected to the actuators 316 to move the optical sensor 304 and guide rail as described, to drive at least one roller 314 to rotate the endless substrate 310, and to engage the endless substrate 310 with the cleaning member 344. The cleaning member 344 removes test pattern material from the endless substrate and lets it fall into the waste receptacle 322. Alternatively, the guide rail 328 and the optical sensor 304 can be fixedly mounted to the printhead 86 so controller 108 can operate actuators 104 to move the printhead and the sensor 304. The endless substrate 310 can be made of a material that supports the build material and the support material ejected from the printhead 86. The tensioning mechanism 348 helps keep the endless substrate 310 taut so it adequately supports the mass of the build material and support material ejected onto the substrate.

Figure 6:
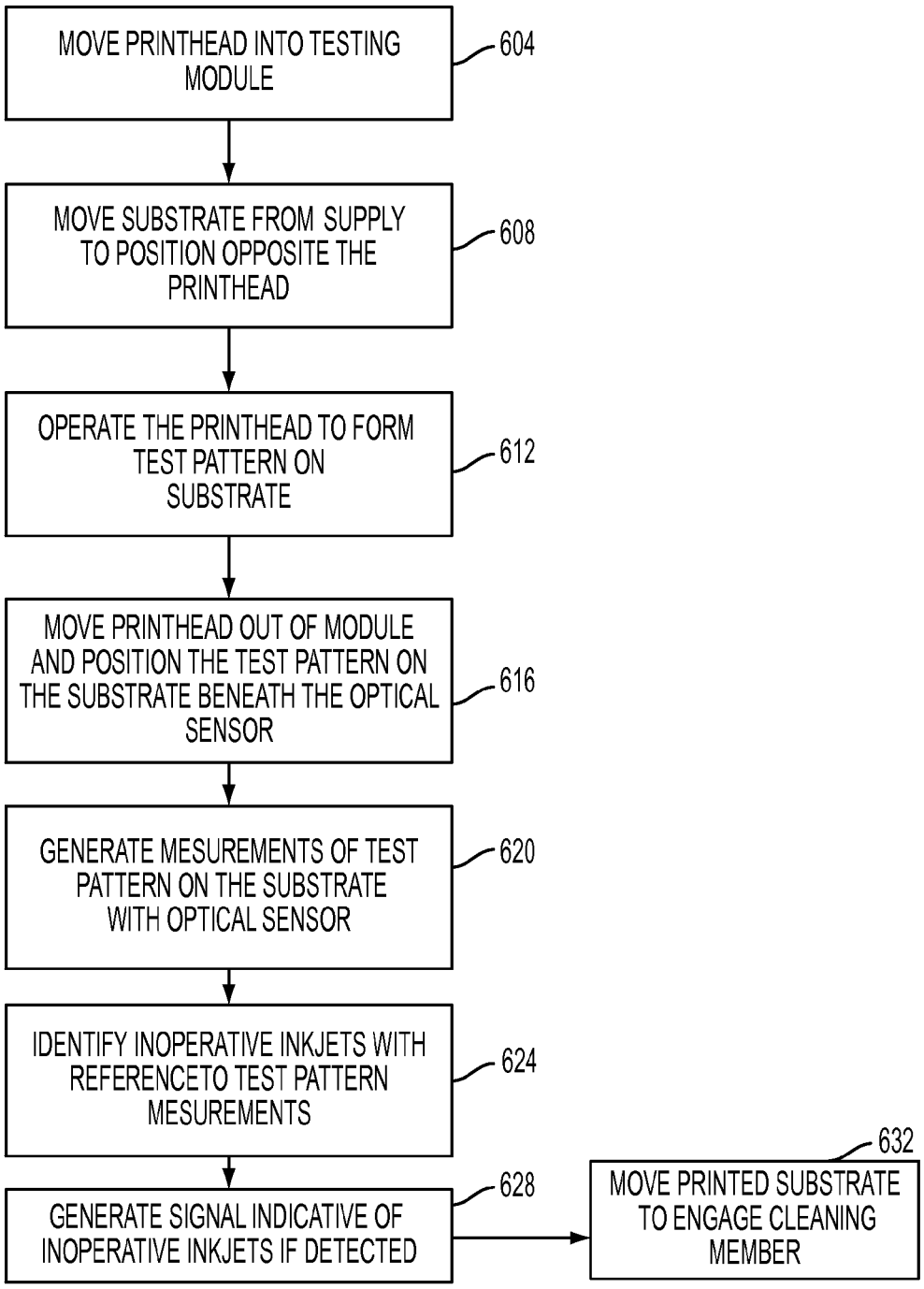
FIG. 6 is a flow diagram of a method for operating the module of FIG. 5.

A method of operating a printer that includes the embodiment shown in FIG. 5 is shown in FIG. 6. In the description of this method, statements that a process is performing some task or function refers to a controller or general purpose processor executing programmed instructions stored in memory operatively connected to the controller or processor to manipulate data or to operate one or more components in the printer to perform the task or function. The controller 324 noted above can be such a controller or processor. Alternatively, the controller 324 can be implemented with more than one processor and associated circuitry and components, each of which is configured to form one or more tasks or functions described herein.

At predetermined times in the printing operation, the controller 108 (FIG. 2) operates an actuator 104 to move the printhead 86 into the module 300 located in the area 112 (block 604). In response to the controller 324 detecting the printhead in the module 300, controller 324 operates an actuator 316 to rotate a clean portion of the endless substrate 310 beneath the printhead 86 (block 608). Controller 324 then generates a signal to the controller 108 to operate the inkjets in the printhead to print a test pattern on the substrate (block 612). In one embodiment, each inkjet in the printhead is repetitively operated to deposit material on a portion of the substrate 304 opposite the inkjet. After the test pattern is printed, controller 108 moves the printhead 86 out of the module 300 and generates a signal for controller 324. In response to the signal from controller 108, controller 324 operates an actuator 316 to move the printed portion of the substrate 308 underneath the optical sensor 304 (block 616). The optical sensor 304 is then moved along the guide rail 328 to emit a light towards the test pattern on the substrate 310, receive the reflections from the test pattern and substrate, and generate electrical signals as measurement data of the test pattern on the substrate 310 (block 620). These measurement data are then analyzed to identify inoperative inkjets (block 624) and, if inoperative inkjets are identified, a signal indicative of the defective printhead is generated for the operator of the printer (block 628). The operator can then take appropriate action. The process continues by the controller 324 operating an actuator 316 to rotate the endless substrate 310 and to engage the endless substrate with the cleaning member 344 (block 632). As the cleaning member 344 removes the material of the test pattern from the endless substrate 310, it drops into the waste receptacle 322. An operator occasionally removes the waste receptacle 322 from the printer and empties the accumulated material removed from the endless substrate.

As noted above, the optical sensor 304 can be a blue laser sensor available from Keyence Corporation of America, Itasca, Ill. in the LJ-V7000 series of two dimensional and three-dimensional laser measurement systems. This sensor can generate measurements of the heights and the diameters of the collections of material drops on the substrate 332 as well as positional data regarding the location of the collections. These data can be used to determine whether the collections are located where they are expected and whether the mass of material is within a predetermined range of tolerance about an expected mass. Measurements that indicate an inkjet is ejecting too much or too little material or is ejecting the material with a skewed trajectory are indicative of inoperative inkjets. Alternatively, the optical sensor 304 can generate image data of the test pattern on the substrate 332 and these image data can be analyzed to identify inoperative inkjets.

It will be appreciated that variants of the above-disclosed and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the following claims.

What is claimed:

1. A printer comprising:

a printhead configured with inkjets to eject material;

a supply of substrate configured to move a substrate to a position opposite the printhead to receive drops of material ejected from inkjets in the printhead;

an optical sensor configured to generate measurements of heights and diameters of drops of material on the substrate and positional data of positions of the drops of material on the substrate;

a transport configured to move the substrate and material on the substrate to a position opposite the optical sensor; and a controller operatively connected to the transport, the optical sensor, and the printhead, the controller being configured to operate the printhead to eject a predetermined number of drops of material from each inkjet in the printhead onto the substrate while the substrate remains stationary at the position opposite the printhead to enable the predetermined number of drops of material to form a test dot for each inkjet in the printhead on the substrate, to operate the transport to move the substrate from being opposite the printhead to being opposite the optical sensor, and to identify inoperable inkjets in the printhead with reference to the height and diameter measurements for each test dot on the substrate and the positional data for each test dot on the substrate received from the optical sensor.

2. The printer of claim 1 wherein the optical sensor is a blue laser sensor.

3. The printer of claim 1, the supply of substrate further comprising:

a plurality of substrate sheets; and the controller is further configured to operate an actuator to move a single substrate sheet from the plurality of substrate sheets to the position opposite the printhead.

4. The printer of claim 1, the supply of substrate further comprising:

an endless belt of substrate entrained about a plurality of rollers; and the controller is further configured to operate an actuator to move the endless belt of substrate about the plurality of rollers.

5. The printer of claim 1, the controller being further configured to operate an actuator to move the optical sensor with respect to the substrate to generate the height and the diameter measurements for each test dot on the substrate and the positional data for the position of each test dot.

6. The printer of claim 5, the controller being further configured to identify inkjets that do not eject drops of material having a predetermined size with reference to the height measurements of the test dots.

7. The printer of claim 5, the controller being further configured to identify inkjets that do not eject drops of material having a predetermined size with reference to the diameter measurements of the test dots.

8. The printer of claim 1, the controller being further configured to identify inkjets that do not eject drops of material having a predetermined size with reference to the positional data for the positions of the test dots.

9. An apparatus comprising:

a supply of substrate;

an optical sensor configured to generate measurements of heights and diameters of drops of material on the substrate, and positional data for positions of drops of material on the substrate;

a transport configured to move the substrate and material on the substrate to a position opposite the optical sensor; and a controller operatively connected to the transport, the optical sensor, the controller being configured to operate the transport to move the substrate to the position opposite the optical sensor after a plurality of inkjets in a printhead has been operated to eject a predetermined number of drops of material from each inkjet in the printhead onto the substrate to form a test dot for each inkjet in the printhead on the substrate, and to identify inoperable inkjets in the printhead with reference to the height and the diameter measurements and the positional data for the test dots received from the optical sensor.

10. The apparatus of claim 9 wherein the optical sensor is a blue laser sensor.

11. The apparatus of claim 9, the supply of substrate further comprising:

a plurality of substrate sheets; and the controller is further configured to operate an actuator to move a single substrate sheet from the plurality of substrate sheets to the position where the printhead is operated to form the test dots.

12. The apparatus of claim 9, the supply of substrate further comprising:

an endless belt of substrate entrained about a plurality of rollers; and the controller is further configured to operate an actuator to move the endless belt of substrate about the plurality of rollers.

13. The apparatus of claim 12 further comprising:

a member positioned adjacent the endless belt of substrate to enable a cleaner to remove ejected material from the endless belt of substrate after the optical sensor has generated the height and the diameter measurements and the positional data.

14. The apparatus of claim 9, the controller being further configured to operate an actuator to move the optical sensor with respect to the substrate to generate the height and the diameter measurements for each test dot and the positional data for the position of each test dot.

15. The apparatus of claim 9, the controller being further configured to identify inkjets that do not eject drops of material having a predetermined size with reference to the height measurements of the test dots.

16. The apparatus of claim 9, the controller being further configured to identify inkjets that do not eject drops of material having a predetermined size with reference to the diameter measurements of the test dots.

17. The apparatus of claim 9, the controller being further configured to identify inkjets that eject misaligned drops of material with reference to the positional data of the position for each test dot.

18. The apparatus of claim 9, the optical sensor being further configured to generate a measurement of a distance between two test dots; and the controller being further configured to identify inkjets that eject misaligned drops of material with reference to the measurement of the distance between two test dots received from the optical sensor.

* * * * *